United States Patent [19]

Rosenfeld

[11] 4,035,937

[45] July 19, 1977

[54] CANDLE WITH INTEGRAL CARD HOLDER

[76] Inventor: Arthur Rosenfeld, 5016 W. Jefferson Blvd., Los Angeles, Calif. 90016

[21] Appl. No.: 684,554

[22] Filed: May 10, 1976

[51] Int. Cl.[2] ..... G09F 3/18

[52] U.S. Cl. ..... 40/16.4; 425/803; 431/289

[58] Field of Search ..... 40/10, 16.2, 16.4; 431/289, 288, 291, 253; 425/803

[56] References Cited

U.S. PATENT DOCUMENTS

| | | | |
|---|---|---|---|
| 3,077,981 | 2/1963 | Gaspard | 431/291 |
| 3,286,492 | 11/1966 | Frazier | 431/291 |
| 3,773,460 | 12/1973 | Tellier | 431/289 |

*Primary Examiner*—Edward G. Favors
*Assistant Examiner*—R. J. Charvat
*Attorney, Agent, or Firm*—Harris, Kern, Wallen & Tinsley

[57] ABSTRACT

A candle having on the periphery thereof circumferentially spaced, vertical ribs respectively provided therein with circumferentially spaced, vertical, opposed grooves which face each other circumferentially and which are respectively adapted to receive vertical edges of a card, or similar article.

3 Claims, 4 Drawing Figures

CANDLE WITH INTEGRAL CARD HOLDER

BACKGROUND OF INVENTION

The present invention relates in general to the candle art and, more particularly, to a candle novelty.

Relevant prior art known to me comprises the following U.S. Pat. Nos:

1,239,838 to Spuchler
2,844,893 to Keller
3,286,492 to Frazier, Jr.
3,744,957 to Wright, Sr.

OBJECTS AND SUMMARY OF INVENTION

The primary object of the present invention is to provide a candle novelty comprising a candle having built-in means for holding and displaying a greeting card, a business card, a photograph, or any similar article of this general nature.

The invention may be summarized as comprising, and an important object is to provide, a candle having formed in the periphery thereof circumferentially spaced, vertical, opposed grooves which face each other circumferentially and which are respectively adapted to receive vertical edges of a card-like article.

Another object is to provide a candle having on its periphery circumferentially spaced, vertical ribs in which the grooves are formed, respectively.

Yet another object is to provide a candle wherein the grooves have closed lower ends serving as seats for the lower edge of the card-like article.

The foregoing objects, advantages, features and results of the present invention, together with various other objects, advantages, features and results thereof which will be evident to those skilled in the candle novelty art in the light of this disclosure, may be achieved with the exemplary embodiment of the invention illustrated in the accompanying drawing and described in detail hereinafter.

DESCRIPTION OF EXEMPLARY EMBODIMENT OF INVENTION

Figure 1:
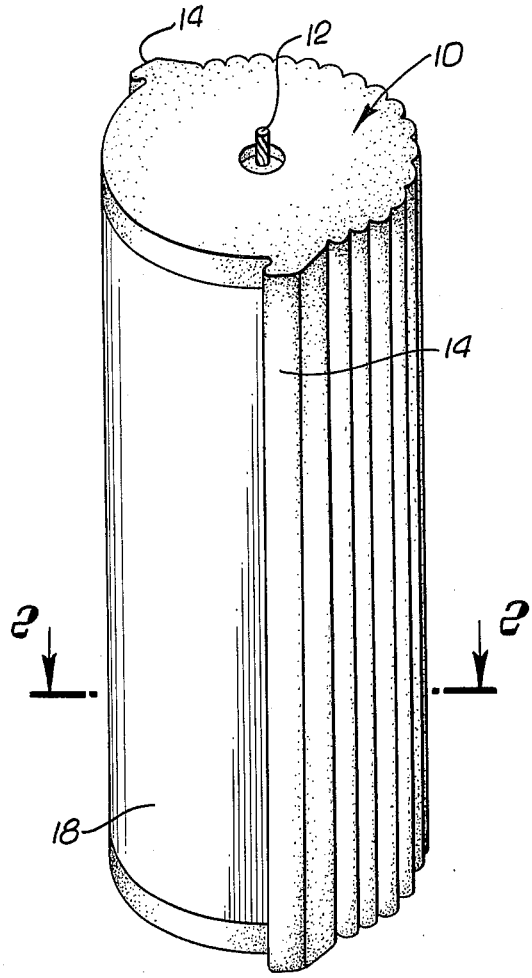
FIG. 1 is an isometric view of a candle or candle novelty which embodies the invention.

Referring to the drawing, the candle or candle novelty of the invention is designated generally by the numeral 10 and includes the usual wick 12.

Built into the candle 10, as an integral part of the wax of which the candle is made, are two circumferentially spaced, vertical ribs 14. Formed in the respective ribs 14 are circumferentially spaced, vertical, opposed grooves 16 which face each other circumferentially and which are respectively adapted to receive edges of a card-like article 18. The latter may be almost anything, such as a business card, a greeting card, a photograph, or the like.

Figure 3:
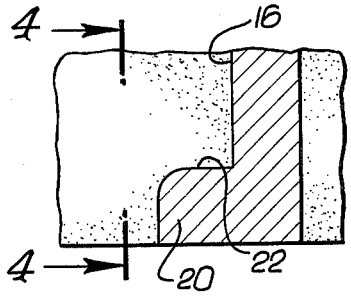
FIG. 3 is an enlarged, fragmentary sectional view taken as indicated by the arrowed line 3—3 of FIG. 2.
Figure 2:
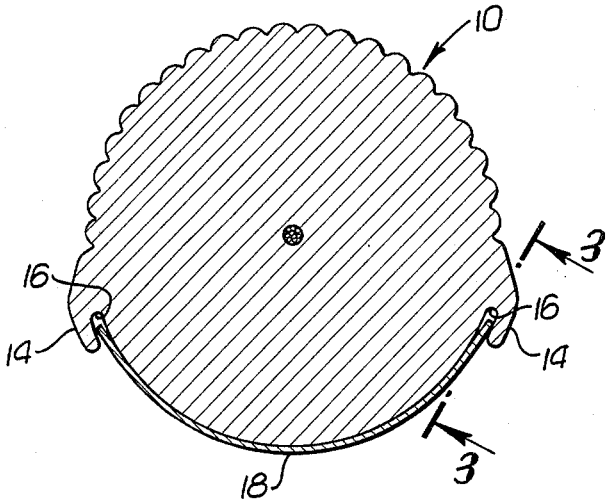
FIG. 2 is a horizontal sectional view taken as indicated by the arrowed line 2—2 of FIG. 1.
Figure 4:
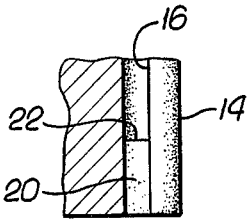
FIG. 4 is a fragmentary sectional view taken as indicated by the arrowed line 4—4 of FIG. 3 of the drawing.

As indicated at 20 in FIGS. 3 and 4 of the drawing, the grooves 16 may be provided at their lower ends with closures 20 providing seats 22 for the lower edge of the article 18. (The grooves 16 may be provided with similar closures at their upper ends.)

As will be apparent, the vertical edges of the article 18 may be inserted in the corresponding grooves 16 readily by bending the article sufficiently to permit such insertion.

The surface of the candle 10 opposite the article 18 may have any desired treatment, such as the fluted treatment shown. Alternatively, it may be left plain.

It will be understood that the candle or candle novelty 10 may be used as a gift item, in which case the article 18 may be a greeting card. However, the utility of the invention is not limited to using it as a gift.

Although an exemplary embodiment of the invention has been disclosed for illustrative purposes, it will be understood that various changes, modifications and substitutions may be incorporated therein without departing from the invention as hereinafter claimed.

I claim as my invention:

1. A candle having formed in the periphery thereof circumferentially spaced, vertical, opposed grooves which face each other circumferentially and which are respectively adapted to receive vertical edges of a card, or similar article.

2. A candle according to claim 1 having on its periphery circumferentially spaced, vertical ribs in which said grooves are formed, respectively.

3. A candle as defined in claim 1 wherein said grooves have closed lower ends.

* * * * *